United States Patent [19]

Heinemann et al.

[11] Patent Number: 4,537,129

[45] Date of Patent: Aug. 27, 1985

[54] OFFSET PRINTING BLANKET

[75] Inventors: Frederick F. Heinemann, Canton; Thomas O. Gavin, Harvard, both of Mass.

[73] Assignee: W. R. Grace & Co., Cambridge, Mass. 02140

[21] Appl. No.: 586,157

[22] Filed: Mar. 5, 1984

Related U.S. Application Data

[62] Division of Ser. No. 172,055, Jul. 25, 1980, Pat. No. 4,452,143.

[51] Int. Cl.[3] ..... B41N 9/00

[52] U.S. Cl. ..... 101/415.1; 428/909; 428/343

[58] Field of Search ..... 428/909, 343; 101/426, 101/415.1, 217, 142

[56] References Cited

U.S. PATENT DOCUMENTS

| | | | |
|---|---|---|---|
| 1,938,301 | 12/1933 | Smith | 428/909 |
| 2,792,322 | 5/1957 | Fredericks | 428/909 |
| 2,793,588 | 5/1957 | Stempel | 101/415.1 |
| 2;804,417 | 8/1957 | Cross et al. | 428/909 |
| 3,012,498 | 12/1961 | Gurin | 101/415.1 |
| 3,147,698 | 9/1964 | Ross . | |
| 3,203,848 | 8/1965 | Ross | 428/909 |
| 3,403,621 | 11/1968 | Simson et al. | 101/142 |
| 3,802,952 | 4/1974 | Gurin et al. | 101/217 X |
| 3,887,750 | 6/1976 | Duckett et al. | 428/909 |
| 4,093,764 | 6/1978 | Duckett et al. | 428/113 |
| 4,303,721 | 12/1981 | Rodriquez | 428/909 |
| 4,452,143 | 6/1984 | Heinemann et al. | 101/415.1 |

FOREIGN PATENT DOCUMENTS

| | | |
|---|---|---|
| 1330008 | 7/1975 | France . |
| 1288321 | 9/1972 | United Kingdom . |

*Primary Examiner*—Edith Buffalow

*Attorney, Agent, or Firm*—William L. Baker; Carole F. Barrett; John Dana Hubbard

[57] ABSTRACT

A method of making-up offset printing cylinders having lock-ups positioned in gaps in the cylinders by use of a two piece system involving adhering a compressible printing element to the cylinder with at least one edge extending into the lock-up gap, trimming the edge extending into the lock-up gap, thereafter pulling a non-compressible printing element carrying the printing ink indicia receptive working surface taut over the compressible printing element and securing the ends of the non-compressible printing element in the lock-up under tension. The two piece system involves separating the relatively thick compressible portion of the offset printing blanket from the relatively thinner ink transfer surface of the offset printing blanket. Also a separate embodiment with pressure sensitive adhesive securing the two piece system together and not limited to offset printing cylinders, product and method.

5 Claims, 4 Drawing Figures

PRIOR ART
LETTERPRESS

PRIOR ART
LETTERPRESS

OFFSET PRINTING BLANKET

This application is a division of application Ser. No. 172,055, filed July 25, 1980, now U.S. Pat. No. 4,452,143.

BACKGROUND OF THE INVENTION

This invention relates to the suitable making up or covering of offset printing cylinders. Offset printing is also called lithographic printing. The invention in certain aspects extends to two piece printing elements in general.

In the past offset printing blankets have been one piece printing blankets having a strong dimensionally stable sublamina or laminas overlaid with compressible lamina or laminas overlaid with an additional strong dimensionally stable lamina which in turn has been overlaid with an ink transfer lamina. One embodiment of such an offset printing blanket is depicted in FIG. 2 as prior art. An edge portion of the offset printing cylinder 10 is shown at the edge of the lock-up gap 11. The blanket is illustrated, extending down into the gap to a lock-up mechanism (not shown) which holds the blanket taut across the cylindrical surface 12 of the offset printing cylinder 10. The blanket as shown has a substantially inextensible woven cotton fabric cylinder ply or lamina 13 which is nominally 13 mils thick, overlaid by a neoprene adhesive lamina 14 which is nominally 1 mil thick, which in turn is overlaid by another substantially inextensible woven cotton fabric lamina 15 which is also nominally 13 mils thick, overlaid with a nitrile adhesive layer 16 which is also nominally 1 mil thick, overlaid by a compressible layer 17 which is nominally 25 mils thick and was made according to U.S. Pat. No. 3,147,698 which is incorporated herein by reference. This compressible layer is overlaid by another nitrile adhesive lamina 18 having a nominal thickness of 1 mil which in turn is overlaid by an extensible nylon fabric lamina 19 having a nominal thickness of 6 mils, and this is overlaid by a nitrile adhesive layer 22 aggressive to nylon having a nominal thickness of 1 mil which in turn is overlaid by an ink transfer working face which is made up of a stiffer under lamina 20 which is nominally 11 mils thick overlaid by the ink transfer face 21 which is also nominally 11 mils thick. The total offset printing blanket thickness of the illustrated embodiment is 82–83 mils and, as already stated, it is of one piece construction. The thickness values given are nominal because each layer varies somewhat in thickness. The described offset printing blanket is sold by W. R. Grace & Co. as POLYWEB* NP Web offset newspaper blankets. Trademark of W. R. Grace & Co.

Because each end of the offset printing blanket must be secured in the lock-up gap of the offset printing cylinder the gap in the cylinder's circumference must be $\frac{1}{4}$–$\frac{3}{4}$ inch wide because each end of the blanket as it enters the gap is 82 mils and the ends generally contain bulky lockup bars. The dimensions of the bars can be reduced commensurate with the reduced thickness and bulk of the blanket portion being secured in the gap as will be obvious to those skilled in the art. If the blanket could be thinned down where it enters the gap, the gap could be narrowed and this would increase the number of printing lines that a cylinder of a given circumference can accommodate. The area of a cylinder circumference taken up by the gap will not accommodate printing lines. The question is how to do this in a manner that will allow long continuous runs and yet retain the high quality printing demanded in offset printing.

Two-piece packing blankets have been known for many years in the newspaper printing art and in the DILITHO* printing art. These two-piece blankets are not involved in the transferring of the printing indicia to the paper but instead are involved in providing a cushion behind the paper when the type is impinged against the paper from the opposite side. Therefore, of course, none of them has the ink transfer working surface. In other aspects of their actual construction detail they are, however, very similar to the two-piece offset printing blanket of the present invention.

In fact, the bottom or compressable layer of the Example of this patent application showing the present invention is the identical material in physical structure to the structure sold by W. R. Grace & Co. as Polyfibron* type NY letterpress packing blanket for Nyloprint* letterpress application which is illustrated in FIG. 3. It has a removable polyethylene release sheet 25, a pressure sensitive adhesive layer 26 which is nominally 2 mils thick, a substantially inextensible woven cotton fabric cylinder ply 27 such as the one described above but having a nominal thickness of only 12 mils, overlaid with a nitrile rubber adhesive 28 having a nominal thickness of 2 mils, overlaid with a compressible layer 29 of the same description given above and having a nominal thickness of 25 mils. The compressible layer 29 is overlaid with a thermosol stabilizing layer 30 that is nominally 9 mils thick.

In letterpress printing the two piece packing's covering element is called a drawsheet. A typical drawsheet is sold by W. R. Grace & Co. as POLYDRAW* newspaper letterpress blanket. Such a drawsheet is shown in FIG. 4. The drawsheet illustrated in FIG. 4 is 33 mils thick and is constructed with a stabilizing cotton fabric ply 31 such as described above that is nominally 15 mils thick that is overlaid with a nitrile adhesive ply 32 that is aggressive to cotton fabric and is nominally 1 mil thick, overlaid with a nitrile adhesive ply 33 that is aggressive to nylon and nominally a half mil thick, overlaid with smooth plain weave nylon fabric 34 that is nominally 4 mils thick woven of nylon multifilament yarns having a denier of 70 with 100 yarns in the warp direction and 90 yarns in the fill direction. The nylon lamina is overlaid with another lamina of nitrile adhesive 35 that is aggressive to nylon and nominally a half mil thick and this in turn is overlaid with a rubber face layer 36 that is nominally 9 mils thick and is not suitable as a transfer surface but instead is suitable in use for backing up paper that is being printed on its exposed surface. *Trademark of ANPA Research Institute, W. R. Grace & Co., BASE and W. R. Grace & Co., respectively.

It is an object of the present invention to provide a method of making-up offset printing cylinders that will enable the reduction in the cylinder lock-up gap thereby increasing the lines of print that a cylinder of a given circumference can accommodate.

A further object is to provide a method of making-up offset printing cylinders that improves the print quality.

Yet another object of the invention is to provide an offset printing blanket that meets both of the objectives given above.

SUMMARY OF THE INVENTION

A method of making-up an offset printing cylinder having a lock-up. The method includes adhering a one piece compressible printing element on the cylinder, extending from one edge of the lock-up gap to beyond the opposite edge of the lock-up gap. That portion of the compressible printing element that extends beyond the edge of the lock-up gap is trimmed to be substanially flush with the edge of the lock-up gap. Then a non-compressible printing ink indicia receptive work surface carrying printing element is pulled taut over the compressible printing element and its ends are secured in the lock-up gap under tension. Preferably the compressible printing element is adhered to the cylinder by an adhesive.

By another aspect of the invention a method is provided for securing a printing element to a cylinder more broadly. The method includes securing a compressible printing element to a cylinder solely by use of a pressure sensitive adhesive layer between their interfacing surfaces, covering the compressible printing element with a non-compressible printing element and securing it to the compressible printing element solely by use of pressure sensitive adhesive and securing the ends of the non-compressible printing element to the cylinder.

The method includes securing the non-compressible printing element directly to the compressible printing element at their interfacing surfaces by the pressure sensitive adhesive which forms a layer between them, no other intermediate structure being present between the non-compressible printing element and the compressible printing element.

By yet another aspect of the present invention, a printing element is provided that includes a compressible printing element that has a pressure sensitive adhesive on one face thereof, a substantially non-extensible lamina adjacent to said pressure sensitive adhesive and a compressible lamina overlying the substantially non-extensible lamina; and a non-compressible printing element that has a pressure sensitive adhesive on one face thereof joined to the compressible printing element, a substantially non-extensible lamina adjacent to the second pressure sensitive adhesive, and an outer working surface lamina overlying the second substantially non-extensible lamina.

Preferably, the printing element has an outer working surface lamina that is a printing ink receptive and transfer working surface and a lamina of hardened, stabilizing material provided in the compressible printing element overlying the compressible lamina.

PREFERRED EMBODIMENTS

Figure 1:
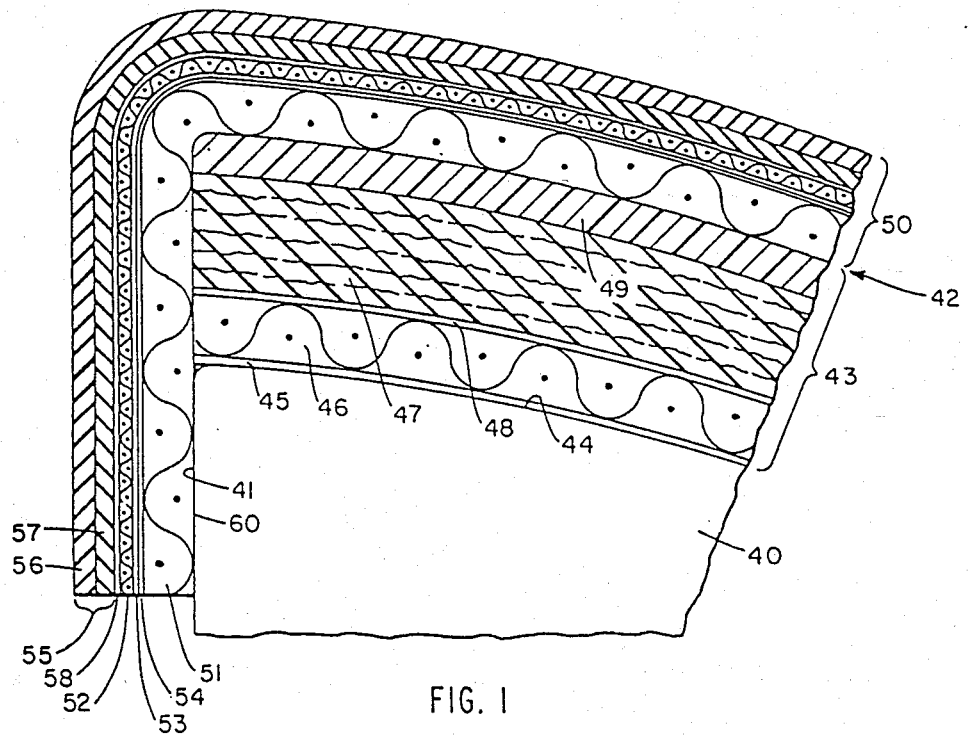
FIG. 1 is a fragmentary section through a made-up offset printing cylinder made up according to the present invention, the fragmentary section being taken at the edge of the lock-up gap.

Looking now at FIG. 1, an offset printing cylinder made up according to the present invention is shown in a presently preferred embodiment. To carry out the method of making up the offset cylinder having a lock-up the procedure given below is executed. The lock-up mechanism itself is not an element of the present invention and therefore is not shown. By the same token, the ends of the printing blanket adapted to match up with the particular lock-up used are not shown as they can be formed in known manner.

The offset cylinder 40 of FIG. 1 is made up according to the present invention by first adhering a one piece compressible printing element around the cylinder. For ease of mounting the compressible element is adhered to the cylinder to extend at least from one edge of the lock-up gap to beyond the opposite edge of the lock-up gap. The edge now extending beyond the edge of the lock-up gap is then trimmed substantially flush with the edge of the lock-up gap to the position illustrated in FIG. 1 for compressible element 43.

Preferably the non-compressible printing ink indicia receptive work surface carrying printing element is kept thin commensurate with suitable ink transfer conformance to the inked indicia and to the surface of the paper being printed and suitable strength for long runs. The preferred thickness is 10–50 mils, more preferably 20–35 mils thick.

The compressible printing element's thickness is dictated largely by three requirements. First, it must be compressible enough to absorb irregularities in the height of surfaces being engaged. Second, it must be thick enough to bring the ink transfer surface of the non-compressible layer to the proper height. Third is to absorb the thickness increase during wraps when the paper breaks and multiple plys wrap anround the cylinder. The compressible element also helps absorb the pressure shock when blanket to blanket and blanket to plate gaps meet; when these gaps meet the nip pressure drops to zero. This is also referred to as cylinder bounce which causes streaks across width of press. Of course, it must have sufficient strength and integrity to hold together over long periods of use. Therefore, it is preferably to reinforce the outer surface with a tough resilient rubber or plastic compound. The preferred thickness of the compressible printing element is about 20 to about 150 mils, preferably about 30 to about 130 mils. It is also important that the compressible printing element have sufficient compressible depth or compressible unit thickness to perform adequately. The compressible unit thickness is preferably about 10 to about 100 mils, more preferably about 20 to about 80 mils.

It is preferable to mount the compressible printing element on the offfset printing cylinder by adhering the element to the cylinder with an adhesive present on the printing element. Other methods of adhering the compressible printing element on the offset printing cylinder would include hot melt adhesives or mechanical members piercing the cylinder engaging face of the compressible printing element.

It is a feature of the present invention that the made-up offset printing cylinder may be operated until the non-compressible printing element is damaged and then it can be replaced without disturbing the compressible printing element. The damaged non-compressible printing element is released from the lock-up and a new non-compressible element pulled taut over the undisturbed compressible printing element and secured by its ends in the lock-up gap.

Furthermore, the compressible printing element can also be stripped from the offset printing cylinder by separating the pressure sensitive adhesive from the cylinder and then be replaced in the manner previously described and the non-compressible printing element that was released for such removal can be replaced all as just described above. Of course, both can be replaced at the same time.

As used herein, offset or offset printing, means any printing method that involves receipt of ink from a plate by an intermediate member, an offset blanket, which transfers the ink to paper or other medium being printed. In its preferred form it is directed to cylindrical offset printing means having some form of lock-up or blanket end securing means.

The invention is further illustrated by the following example:

EXAMPLE

Looking at FIG. 1, a two piece offset printing blanket 42 of this present invention is shown mounted on an offset printing cylinder 40 having a printing gap 41 and an outer circumferential surface 44.

Figure 3:
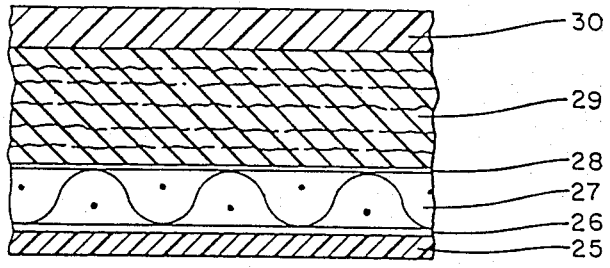
FIG. 3 is a fragmentary sectional view of the under packing for a letterpress.

A one piece compressible printing element 43 was adhered directly on the cylindrical surface 44 of the offset printing cylinder 40 through the use of pressure sensitive adhesive layer 45. It will be understood that a release sheet (not shown), such as shown in the prior art FIG. 3 as 25, was initially present, covering the pressure sensitive adhesive. The release sheet was, of course, removed allowing the compressible printing element to be adhered to the printing cylinder. The pressure sensitive adhesive had a nominal thickness of 2 mils.

A cylinder ply 46 overlies the pressure sensitive adhesive and provides strength and stability against longitudinal and lateral stretching. The cylinder ply was a low stretch cotton fabric of high strength having a nominal thickness of 12 mils. The cylinder ply was overlaid with a nitrile adhesive lamina 48 which had a nominal thickness of 2 mils. The nitrile adhesive was overlaid with a compressible ply 47 which was constructed according to U.S. Pat. No. 3,147,698. The nominal thickness of the compressible lamina was 25 mils. The nitrile adhesive serves to adhere the cylinder ply to the compressible ply and also adds thickness to the compressible printing element. The compressible layer 47 had a face coating or force transfer hardened thermosol coating 49 on it to harden and stabilize it and provide a force transfer hardened outer surface in the nature of a hardened surface of strong integrity on the compressible printing element 43. The lamina 49 had a nominal thickness of 9 mils and also provided thickness to the compressible printing element 43.

The thermosol had the following composition: 60 parts dioctyl phthalate, 100 parts of a dispersion grade polyvinyl chloride resin (Geon 121, B. F. Goodrich), 25 parts of a phenolic resin (SP 6600, Schenectady Chemicals, Inc.), 15 parts trimethylol propane trimethacrylate (Monsanto X980, Rohm and Haas), 3 parts barium-cadmium-zinc stabilizer (6V 6A, Fero Chemical Corp.); 0.3 parts, 40% organic peroxide on insert filler (Luperco 231XL, Pennwalt Corp.). The composition was prepared by charging the ingredients in the order in which they are listed to a reactor maintained at 75° F. while stirring. After complete mixing which required approximately 45–60 minutes a thick liquid having a viscosity of about 20,000 to 30,000 cps was obtained. This was knife coated on the compressible lamina and cured at 340° F. for about 5 minutes.

The compressible elemet 43 was applied to the cylinder by lining up one end's edge with one edge of the gap 41 and allowing the opposite end to extend out into the gap from the gap's opposite side.

Then the portion of the compressible element end extending over into the gap was trimmed back to the edge of the gap. The total thickness of the compressible printing element was 50 mils.

Figure 4:
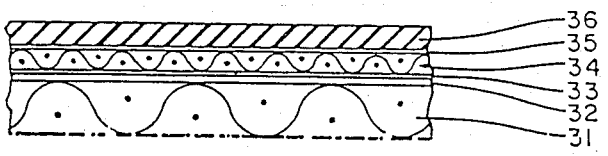
FIG. 4 is a fragmentary sectional view of the drawsheet for a letterpress.

The non-compressible printing ink indicia receptive work surface carrying printing element 50 had a cylinder ply or lamina 51 which was of the similar construction as the compressible element's ply 46 and also had a nominal thickness of 15 mils. The lamina 51 was overlaid with a nitrile adhesive layer 54 having a nominal thickness of 1 mil which was aggressive for cotton which in turn was overlaid with a nitrile adhesive layer 53 having a nominal thickness of 1 mil which was aggressive for nylon. The adhesive layer 53 was overlaid with a woven nylon fabric of same construction as the fabric 34 of the drawsheet of FIG. 4 having a nominal thickness of 4 mils. The nylon lamina was overlaid with a nitrile adhesive layer 58 aggressive for nylon having a nominal thickness of 2 mils which was in turn overlaid by the ink indicia receptive and transfer work surface 55 which consist of two layers 56 and 57 each of which was nominally 5 mils thick and were of the same construction as in the one piece offset printing blanket of FIG. 2.

The total thickness of the non-compressible offset printing element 50 was 33 mils. This gives a total two piece offset printing blanket nominal thickness of 83 mils.

The non-compressible printing element 50 was positioned over the compressible printing element 43 and pulled taut thereover. The ends of the non-compressible printing element were secured in the lock-up gap under tension.

Figure 2:
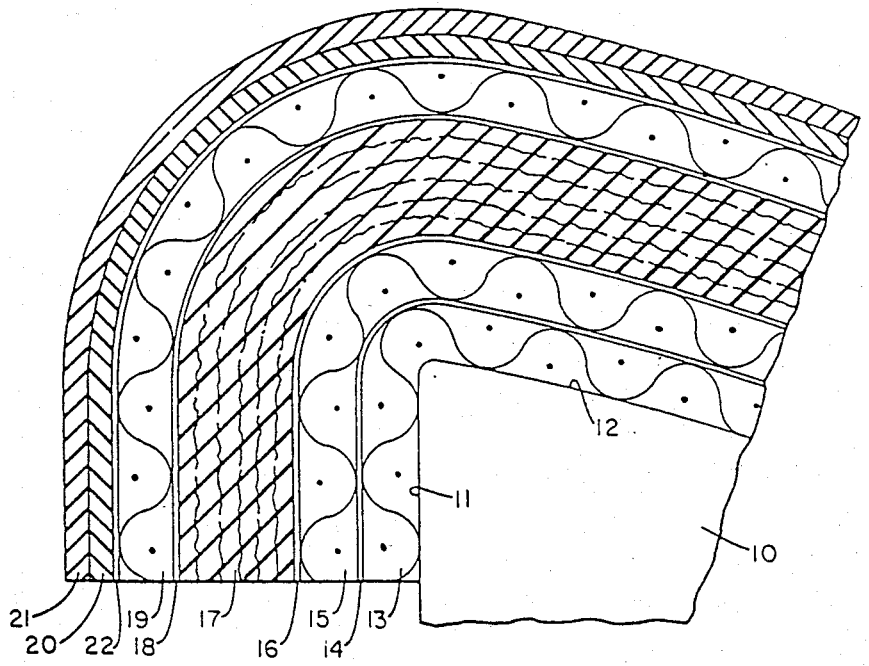
PRIOR ART FIG. 2
FIG. 2 is a fragmentary sectional view, similar to FIG. 1, of an offset printing cylinder made up with the one piece printing blanket of the prior art.

The made-up offset printing cylinder was run for a number of months on test and the printing quality has been compared with the quality of an equivalent offset printing cylinder made-up with the one piece offset printing blanket of FIG. 2. The print quality appeared to the unaided eye to be a little superior with the cylinder made-up with the two piece blanket of this example.

It is surprising that the two piece offset printing blanket of the present invention has even been able to meet the quality of the one piece offset printing blanket much less exceed it. It is understood that two piece systems have been tried at least two times in previous years but that problems with wrinkling or tucking occurred and thus such undertakings were not pursued. Even in the early work on the present invention wrinkling proved to be a problem.

There is another preferred embodiment that is substantially the same as described in the Example except the non-compressible offset printing element is thinner. With this embodiment paper packing sheets are placed between the compressible offset printing element and the non-compressible offset printing element to adjust the overall thickness of the two piece offset printing blanket to the exact desired thickness. Such a combination allows for greater variation flexibility in use. One piece offset printing blanks requiring paper packing sheets under them to increase their height are presently sold by W. R. Grace & Co. In a specific embodiment of the two piece blanket the reduced thickness is provided by using a thinner cotton fabric at 51 of FIG. 1, nominally 12 mils rather than 15, thinner adhesive layers 53, 54 and 58, each being nominally ½ mil thick and the two ink receptive layers 56 and 57 were each nominally 4 mils thick giving a total non-compressible printing element thickness of nominally 25½ mils.

One other embodiment of the present invention that is preferred but not yet completely developed is the application of pressure sensitive adhesive on the under surface or inside or bottom surface 60 of the non-compressible offset printing element 50 to stabilize its surface contact with the compressible offset printing element 43. Those skilled in the art will understand that prior to mounting the pressure sensitive adhesive would be covered with a release sheet which would be removed at the time of mounting. The use of pressure sensitive adhesive on the bottom surface of the non-compressible offset printing element will reduce the amount of force needed to lock-up the ends of the non-compressible offset printing element and secure it in position. The pressure sensitive adhesive joining of the non-compressible offset printing element to the compressible offset printing element still allows for the stripping off of and replacement of the non-compressible offset printing element without requiring the replacement or stripping of the compressible printing element from the offset printing cylinder. This aspect of the invention could also be applied to drawsheets used in packing for securement to under packing. Thus, it could have applicability to any printing element for a cylinder in a printing machine.

Furthermore, intermediate filler and/or compressible elements having pressure sensitive surfaces can be inserted between the described non-compressible printing element and the compressible printing element to both thicken the two piece printing element and/or add additional compressibility and opportunities for use of a basic few units on a wide variety of presses.

By lock-up it is not meant any particular form of securement arrangement. For example, in some instances magnets may be used or simply a wedging of the ends of the non-compressible offset printing element into a slot or gap.

We claim:

1. A printing element attached to a printing cylinder having a lock-up gap comprising a compressible printing element attached to the cylinder, the compressible printing element having a first and second edge, the first edge being substantially flush with a first edge of the lock-up gap and the second edge being substantially flush with a second edge of the lock-up gap, a non-compressible printing element having a first and second end portion, the first end portion directly engaging the first edge of the compressible printing element and extending into the lock-up gap, the second end portion directly engaging the second edge of the compressible printing element and extending into the lock-up gap, a portion of the non-compressible printing element, intermediate the first and second end portions, overlaying and directly engaging the compressible printing element and the non-compressible printing element being secured to the cylinder at its first and second end portions by a lock-up means in the lock-up gap.

2. The printing element of claim 1 wherein the compressible printing element is attached to the cylinder solely by adhesives.

3. The printing element of claim 1 wherein the compressible printing element is attached to the cylinder solely by pressure sensitive adhesives.

4. The printing element of claim 1 wherein the non-compressible printing element is secured directly to the compressible printing element at their interfacing surfaces by an adhesive which forms a lamina between them, no other intermediate structure being present between the non-compressible printing element and the compressible printing element.

5. The printing element of claim 4 wherein the adhesives which form the lamina between the non-compressible and compressible printing elements are pressure sensitive adhesives.

* * * * *